US006102746A

United States Patent [19]

Nania et al.

[11] Patent Number: 6,102,746

[45] Date of Patent: Aug. 15, 2000

[54] COAXIAL ELECTRICAL CONNECTOR WITH RESILIENT CONDUCTIVE WIRES

[75] Inventors: Frank A. Nania, Acton; Donald R. LaCoy, Boylston, both of Mass.

[73] Assignee: Hypertronics Corporation, Hudson, Mass.

[21] Appl. No.: 09/302,580

[22] Filed: Apr. 30, 1999

[51] Int. Cl.[7] ..... H01R 24/00; H01R 33/20

[52] U.S. Cl. ..... 439/675; 439/843; 439/847

[58] Field of Search ..... 439/578, 675, 439/843, 844, 846, 847

[56] References Cited

U.S. PATENT DOCUMENTS

| | | | |
|---|---|---|---|
| 1,833,145 | 11/1931 | Wilhelm . | |
| 2,900,631 | 8/1959 | Love . | |
| 2,983,779 | 5/1961 | Dumire et al. . | |
| 3,023,789 | 3/1962 | Bonhomme . | |
| 3,107,966 | 10/1963 | Bonhomme . | |
| 3,229,356 | 1/1966 | Bonhomme . | |
| 3,364,302 | 1/1968 | Slick | 174/75 R |
| 3,470,527 | 9/1969 | Bonhomme | 439/843 |
| 3,557,428 | 1/1971 | Bonhomme | 29/747 |
| 3,858,956 | 1/1975 | Garrett | 339/14 P |
| 3,858,962 | 1/1975 | Bonhomme | 339/256 |
| 4,411,277 | 10/1983 | Dickhudt | 128/784 |
| 4,426,127 | 1/1984 | Kubota | 339/177 R |
| 4,842,553 | 6/1989 | Ingram | 439/583 |
| 5,118,905 | 6/1992 | Harada | 174/109 |
| 5,137,470 | 8/1992 | Doles | 439/578 |
| 5,273,455 | 12/1993 | MacLellan | 439/387 |
| 5,439,393 | 8/1995 | Watson | 439/578 |
| 5,562,482 | 10/1996 | Wright | 439/429 |

FOREIGN PATENT DOCUMENTS

| | | |
|---|---|---|
| 0251158 | 1/1988 | European Pat. Off. . |
| 931634 | 2/1948 | France . |
| 497338 | 5/1930 | Germany . |
| 3721965 | 1/1989 | Germany . |
| 4222206 | 1/1994 | Germany . |
| 903641 | 8/1962 | United Kingdom . |

OTHER PUBLICATIONS

R. Eberlein, ODU Springwire Concept, http://www.odu–usa.com/concept.html 1996, no month shown.

R. Eberlein, ODU High Current Springtac Contact, http://www.odu–usa.com/springtac3.html 1996, no month shown.

R. Eberlein, ODU High Current Springtac Contact, http://www.odu–usa.com/springtac5.html 1996, no month shown.

R. Eberlein, ODU Products–Springwire Contacts, http://www.odu–usa.com/springwire.html 1996, no month shown.

R. Eberlein, About ODU, http://www.odu–usa.com/about.html 1996, no month shown.

*Primary Examiner*—Lincoln Donovan
*Assistant Examiner*—Javaid Nasri
*Attorney, Agent, or Firm*—Finnegan, Henderson, Farabow, Garrett & Dunner, L.L.P.

[57] ABSTRACT

A female electrical connector for mating with a male counterpart is provided. The female connector includes an outer structure and an inner structure. The outer structure has a first inner surface for receiving a first contact member of the male counterpart. The inner structure includes at least one resilient conducting wire mounted within the inner structure for contacting the second contact member of the male counterpart upon insertion of the second contact member of the male counterpart into the inner structure. The at least one resilient conducting wire has opposite ends and a central portion. The opposite ends are contacting and fixed to the inner structure. The central portion is spaced from the second inner surface prior to insertion of the second contact member of the male counterpart into the inner structure and displaced toward the second inner surface upon insertion of the second contact member of the male counterpart into the inner structure. The connector may include a plurality of the resilient conducting wires, the wires extending at a non-intersecting angle to the longitudinal axis in order to form a hyperboloid shape. Alternately, the connector may include a plurality of the resilient conducting wires extending generally parallel to the longitudinal axis. Typically, the inner and outer structure are coaxial.

47 Claims, 8 Drawing Sheets

COAXIAL ELECTRICAL CONNECTOR WITH RESILIENT CONDUCTIVE WIRES

BACKGROUND OF THE INVENTION

1. Field of the Invention

The present invention relates to electrical connectors for connecting coaxial cables to one another.

2. Description of the Related Art

Electrical connectors having coaxial contact structures are typically used to connect two coaxial cables to one another. A coaxial cable has an inner and an outer conductor member which share a common axis. Coaxial cables are often used in applications where it is desirable to operate at high frequencies while reducing the interference of a high frequency signal. For this reason, the outer conductor member of a coaxial cable will often serve as a shield for the inner conductor member which carries the signal. Alternately, the outer conducting member of a coaxial cable may be used to carry an additional signal.

When connecting coaxial cables it is desirable that the coupling has a low mating force, particularly if the coupling is to be ganged with a large number of other couplings. It is also desirable that the coupling has a long life. However, high mating forces in existing couplings make it difficult to achieve a long life, because a high mating force greatly reduces the number of mating cycles a coupling can endure.

In the past, the outer contact structure of a coaxial electrical connector has used hyperbolic contact wires in order to improve the quality of electrical contact in the fashion shown, for example, in U.S. Pat. Nos. 3,107,966 and 3,470,527 to F. R. Bonhomme. No one contemplated or explored the possibility of constructing a coaxial connector with an inner cylindrical member having hyperbolic or other conducting wires because of physical and electrical construction constraints inherent in designing such an inherently small inner cylindrical member. For example, these constraints include the size of such wires and whether they could be made sufficiently small to fit inside the inner member and reliably function without failure during repeated connection and disconnection, while not adversely affecting the electrical properties of the connector.

SUMMARY OF THE INVENTION

The advantages and purpose of the invention will be set forth in part in the description which follows, and in part will be obvious from the description, or may be learned by practice of the invention. The advantages and purpose of the invention will be realized and attained by means of the elements and combinations particularly pointed out in the appended claims.

To achieve these and other advantages and in accordance with the purpose of the invention, as embodied and broadly described herein, the invention includes a female electrical connector for mating with a male counterpart. The female connector includes an outer structure and an inner structure. The outer structure has a longitudinal axis and a first inner surface for receiving a first contact member of the male counterpart. The outer structure further includes a first conductive contact structure mounted within the outer structure for contacting the first contact member of the male counterpart upon insertion of the first contact member of the male counterpart into the outer structure. The inner structure has a longitudinal axis and a second inner surface for receiving a second contact member of the male counterpart. The inner structure further includes at least one resilient conducting wire mounted within the inner structure for contacting the second contact member of the male counterpart upon insertion of the second contact member of the male counterpart into the inner structure. The at least one resilient conducting wire has opposite ends and a central portion. The opposite ends are contacting and fixed to the inner structure. The central portion is spaced from the second inner surface prior to insertion of the second contact member of the male counterpart into the inner structure and displaced toward the second inner surface upon insertion of the second contact member of the male counterpart into the inner structure.

In a further aspect of the invention, the at least one resilient conducting wire of the inner structure extends at a non-intersecting angle to the longitudinal axis of the inner structure. The resilient conducting wire is held in position so that the central portion is suspended from the second inner surface prior to insertion of the second contact member of the male counterpart into the inner structure.

In a further aspect, the inner structure may include a plurality of the resilient conducting wires, each resilient conducting wire extending at a non-intersecting angle to the longitudinal axis of the inner structure so that the central portion is suspended from the second inner surface. The plurality of resilient conducting wires form a generally hyperboloid shape prior to insertion of the second contact member of the male counterpart into the inner structure.

In a yet further aspect, the resilient conducting wires of the inner and/or outer structure extend generally parallel to the longitudinal axis and are bent so that the central portion of each wire is suspended from its respective inner surface prior to insertion of the male counterpart into the female connector.

In a still further aspect, the present invention is directed towards an electrical coupling including a female connector and a male connector. In this aspect of the invention, the female connector has an outer structure and an inner structure. The outer structure of the female connector has a first inner surface for receiving an outer structure of the male connector, the outer structure of the female connector including a first conductive contact structure mounted within the female outer structure for contacting an outer contact member of the male connector upon insertion of the outer contact member of the male connector into the outer structure of the female connector. The inner structure of the female connector includes one of a pin and a female member for receiving the pin. The male connector has an outer structure and an inner structure. The outer structure of the male connector includes the outer contact member for contacting the first conductive contact structure of the female connector upon insertion of the outer contact member of the male connector into the outer structure of the female connector. The inner structure of the male connector includes the other of the pin and the female member for receiving the pin. The female member for receiving the pin has a second inner surface for receiving the pin. The female member includes at least one resilient conducting wire mounted within the female member for contacting the pin upon insertion of the pin into the female member, the at least one resilient conducting wire having opposite ends and a central portion. The opposite ends are contacting and fixed to the female member. The central portion is spaced from the second inner surface prior to insertion of the pin into the female member and displaced toward the second inner surface upon insertion of the pin into the female member.

In a further aspect, the invention includes a female connector for simultaneously coupling multiple coaxial cables in parallel. The female connector includes a female coupling body having a plurality of sockets opening through an end face of the coupling body.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate several embodiments of the invention and together with the description, serve to explain the principles of the invention. In the drawings.

DETAILED DESCRIPTION OF THE PREFERRED EMBODIMENTS

Reference will now be made in detail to the structure of the present preferred embodiments, examples of which are illustrated in the accompanying drawings. Wherever possible, the same reference numbers will be used throughout the drawings to refer to the same or like parts.

In accordance with the present invention, a female electrical connector is provided for contacting a male counterpart. The female electrical connector includes an outer structure and an inner structure. The outer structure has a longitudinal axis and a first inner surface for receiving a first contact member of the male counterpart. The outer structure further includes a first conductive contact structure mounted within the outer structure for contacting the first contact member of the male counterpart upon insertion of the first contact member of the male counterpart into the outer structure.

Figure 1:
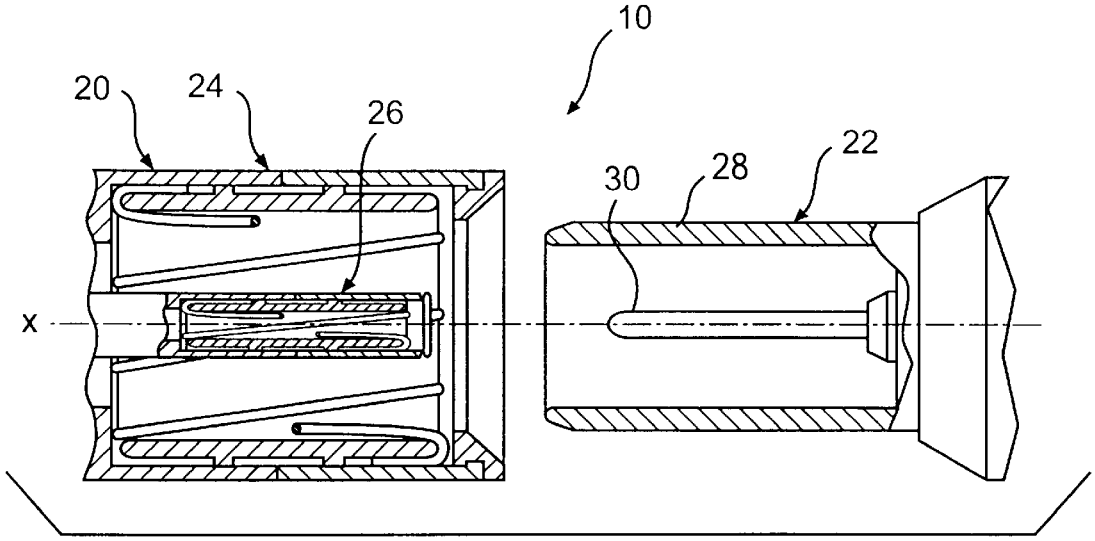
FIG. 1 is a cross-sectional view of an electrical coupling with a female electrical connector and male counterpart connector in accordance with the invention.

An exemplary embodiment of the female electrical connector is shown in FIGS. 1–6. In the illustrated exemplary embodiment, the female electrical connector engages with a corresponding male connector as shown in FIG. 1 to form an electrical coupling. The electrical coupling 10 is generally comprised of two main components, a female electrical connector 20 and a corresponding male electrical connector 22. When the female connector and male connector are axially mated together, the electrical signals from two coaxial cables may be transmitted therebetween. The electrical signals are transmitted by means of the inner and outer contact structure of the female electrical connector 20 coming into contact with an inner and outer contact structure of the corresponding male electrical connector 22 when the male and female connectors are axially engaged as described below.

Figure 2:
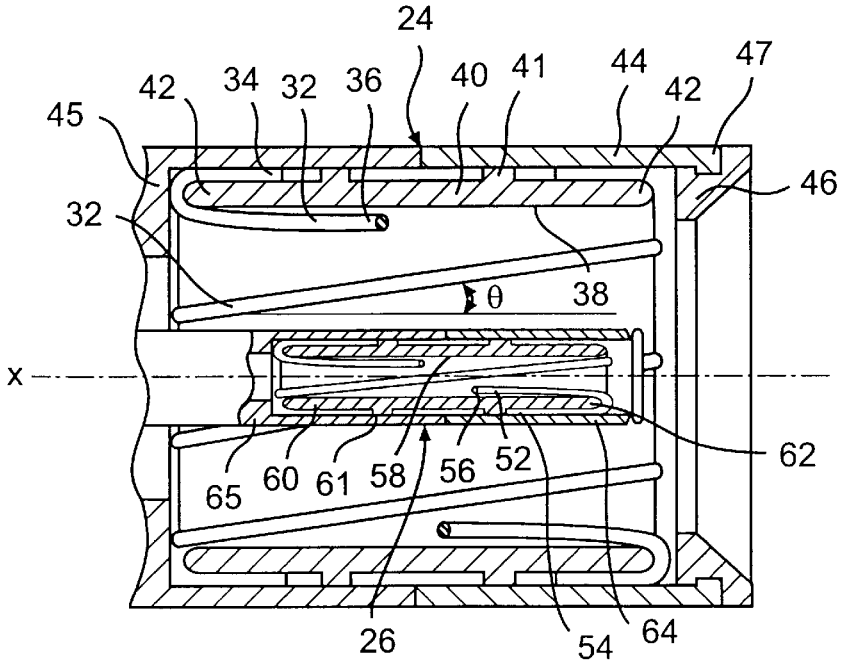
FIG. 2 is a cross-sectional view of the female electrical connector of FIG. 1 along line 2—2 of FIG. 3.
Figure 3:
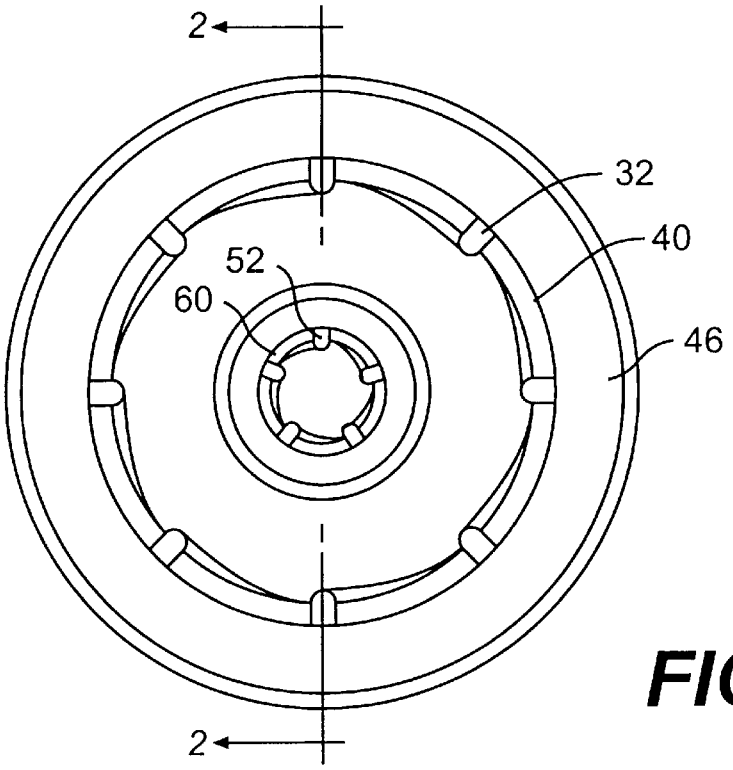
FIG. 3 is an end view of the female electrical connector of FIG. 1.
Figure 4:
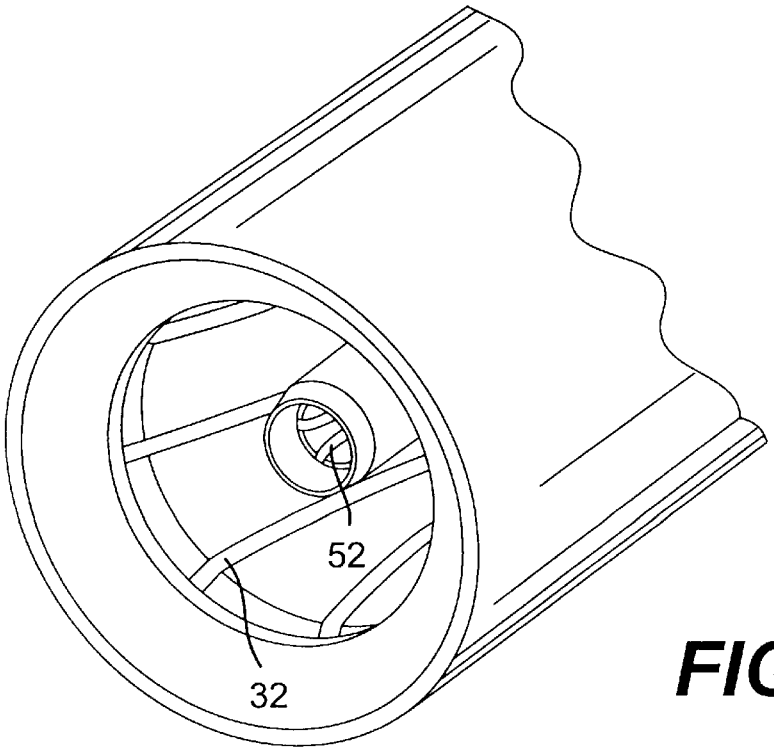
FIG. 4 is a perspective view of the female electrical connector of FIG. 1.
Figure 5:
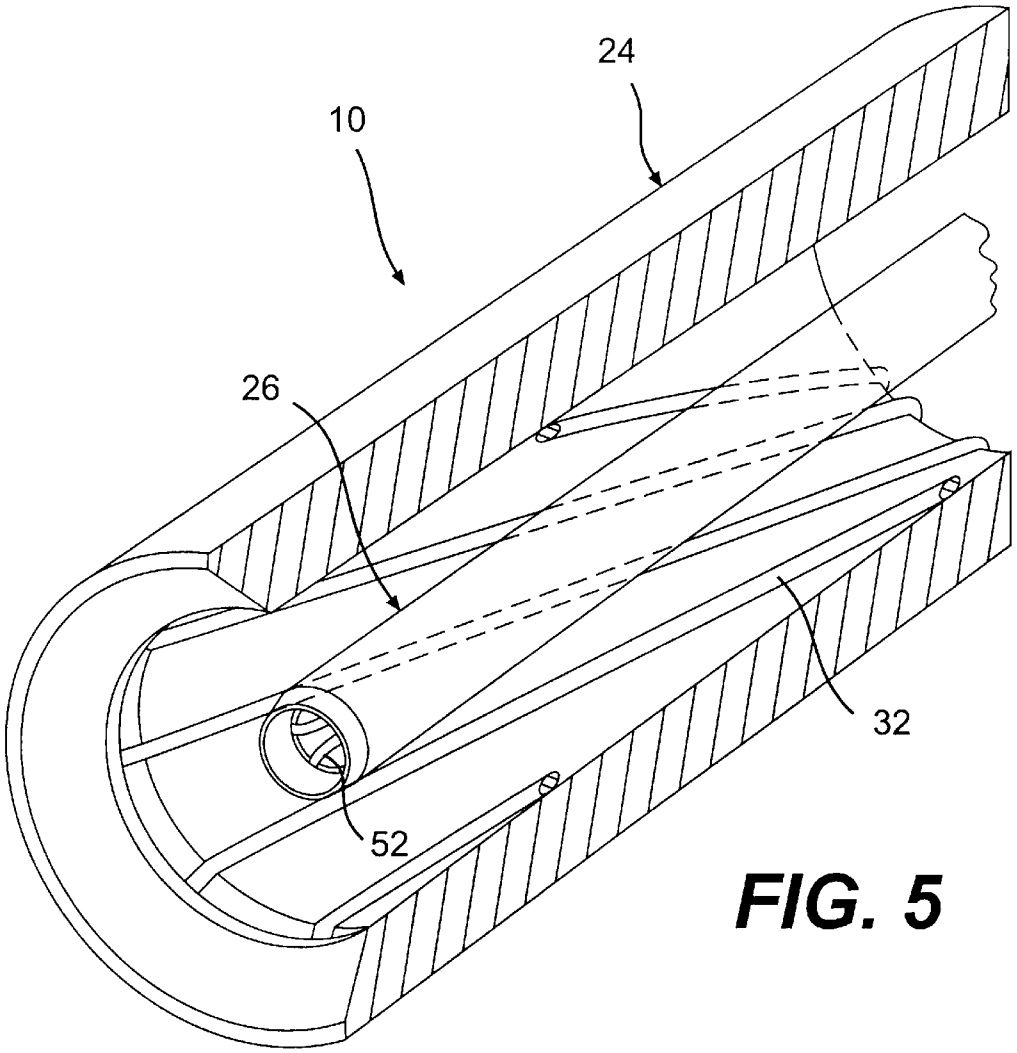
FIG. 5 is a partial perspective view of the female electrical connector of FIG. 1.

In the illustrated embodiment, the female electrical connector 20 is in the form of a socket. Female electrical connector 20 includes an outer tubular assembly 24 and an inner tubular assembly 26. The outer tubular assembly 24 has a longitudinal axis x, and includes a first inner surface 38 for receiving a first contact member 28 of the male counterpart 22. The first contact member 28 of the male counterpart is an axially projecting cylindrical sleeve or contact prong with an outer diameter slightly smaller than the inner diameter of the first inner surface. FIGS. 1 and 2 are cross-sections through the longitudinal axis x.

In the illustrated embodiment, outer tubular assembly 24 of the female connector includes a first conductive contact assembly mounted within the outer structure for contacting the first contact member 28 of the male counterpart upon insertion of the first contact member 28 of the male counterpart into the outer tubular assembly. The first conductive contact assembly of the outer structure includes at least one resilient conducting wire 32. The resilient conducting wire 32 has opposite ends 34 contacting and being fixed to the outer tubular assembly. The resilient conducting wire also includes a central portion 36 spaced from the first inner surface 38 prior to insertion of the first contact member 28 of the male counterpart 22 into the outer tubular assembly. The central portion 36 is displaced toward the first inner surface 38 upon insertion of the first contact member 28 of the male counterpart into the outer tubular assembly of the female connector.

In accordance with the present invention, the outer structure of the first conductive contact structure includes a plurality of the resilient conducting wires. The plurality of wires forms a generally hyperboloid shape prior to insertion of the first contact member of the male counterpart into the outer structure.

In the illustrated embodiment of FIGS. 1–6, the outer tubular assembly 24 includes a plurality of the resilient conducting wires 32. However, it should be understood that the outer tubular assembly may have as few as one resilient conducting wire. The number of wires can be increased so that the contact area is distributed over a larger surface of the male counterpart. Each resilient conducting wire 32 extends at a non-intersecting angle $\theta$ to the longitudinal axis x of the outer tubular assembly. The typical angle $\theta$ between each wire and the longitudinal axis is between approximately 6 to 15 degrees. The value of the angle $\theta$ can be varied depending on the specific dimensions and requirements of the connector. As the angle increases, the insertion/extraction force will also be increased. Therefore, the pin insertion/extraction force can be controlled by varying the angle of the resilient conducting wires when designing the coupling. Each resilient conducting wire 32 is held in position so that the central portion 36 of the wire is suspended from the first inner surface 38 prior to insertion of the first contact member 28 of the male counterpart 22 into the outer tubular assembly.

The resilient conducting wires will typically be held in tension to ensure that each wire extends in a straight line between the ends of the first inner surface. As previously discussed, the straight line of each wire extends at a non-intersecting angle to the longitudinal axis of the outer tubular assembly.

Figure 6:
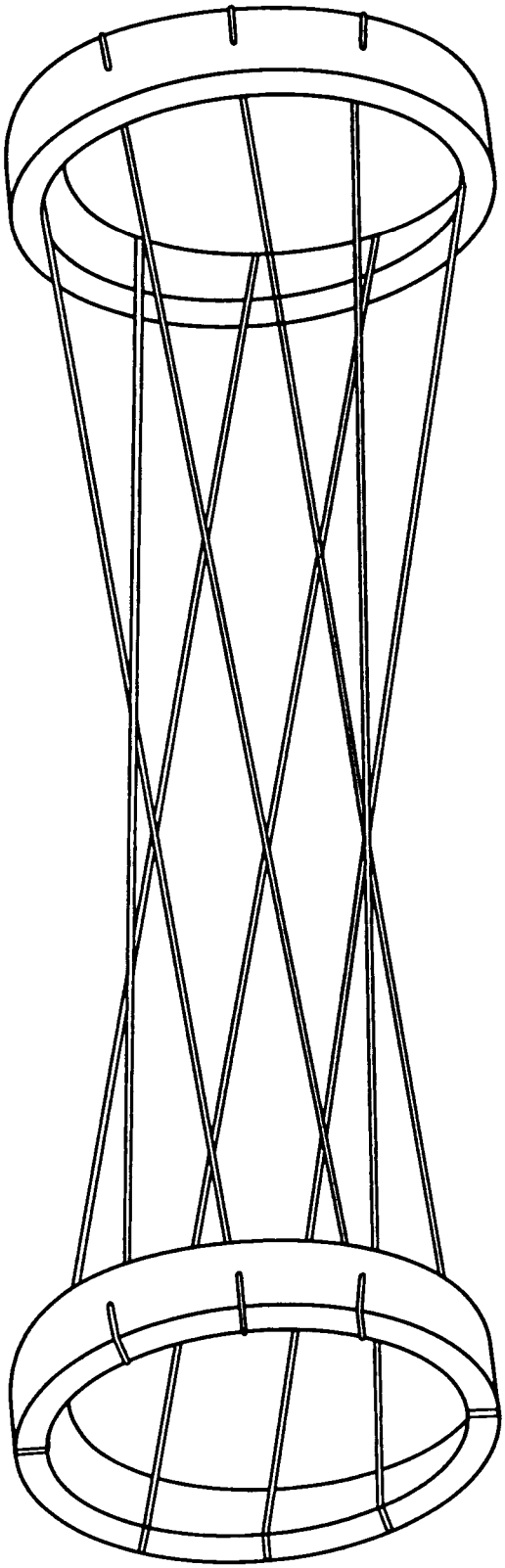
FIG. 6 is a schematic showing the hyperbolic design of the wires of the female electrical connector of FIG. 1.

In the illustrated embodiment, by providing a plurality of resilient wires 32 at a non-intersecting angle θ to the longitudinal axis, the plurality of wires forms a generally hyperboloid shape. The generally hyperboloid shape is shown schematically in FIG. 6. In FIG. 6, the center portions of the axial sleeves have been removed in order to more clearly illustrate the hyperboloid shape. The plurality of resilient conducting wires form the generally hyperboloid shape shown in FIG. 6 prior to insertion of the first contact member 28 of the male counterpart into the outer tubular assembly 24. The wires 32 are typically attached in tension. Tension in the wire ensures that the wires will extend from one end to the other in a straight line. Alternatively, the wires could be non-stressed or in compression, as long as the wires do not bend and continue to extend in a straight line prior to insertion of the male counterpart. Upon insertion of a male counterpart, the wires will stretch to accommodate the shape of the male counterpart. The wires will no longer extend in a straight line upon insertion of the male counterpart.

The outer tubular assembly 24 further includes an inner axial sleeve 40 and outer axial sleeve 44. Inner axial sleeve 40 is a cylindrical sleeve on which the first inner surface 38 is located. The inner axial sleeve 40 has radial projections 41 which abut against an inside surface of the outer axial sleeve 44. The radial projections have a height approximately the same as the diameter of the conducting wires 32. Alternately, a single radial projection could be provided instead of the two radial projections shown in the illustrated embodiment. In another alternative arrangement, radial projections are not needed because the wires 32 serve to space the inner axial sleeve 40 from the outer axial sleeve 44. The wires would serve the same purpose as the radial projections.

Outer axial sleeve 44 surrounds inner axial sleeve 40, and extends from the base 45 of the female connector. Outer axial sleeve 44 is typically comprised of two axially abutting sleeves. In the embodiment shown in FIGS. 1–6, the opposite ends of the wires wrap around the axial ends 42 of the inner axial sleeve 40 and are press-fit between the inner axial sleeve 40 and the outer axial sleeve 44. The wires 32 are assembled in the outer tubular assembly by bending the wires around the inner axial sleeve 40 at both ends, holding the wires in position with tooling, and then sliding the outer axial sleeves from each end to press fit the wire between the inner and outer axial sleeve. The sliding of the outer axial sleeves from each end during assembly typically creates tension in each wire. The opposite ends of the wires can be attached to the outer tubular assembly 24 by a variety of other methods including brazing, soldering, welding, gluing, or press-fitting with a washer.

Alternately, the outer axial sleeve 44 could be constructed of a single sleeve. If the outer axial sleeve 44 is constructed of a single sleeve without an angle ring, the end of the outer axial sleeve will preferably be rolled radially inwardly in order to protect the bent portion of the wires from physically contacting the first contact member 28 of the male counterpart 22 upon insertion of the male counterpart into the female connector.

In the illustrated embodiment, outer tubular assembly 24 further includes an angle ring 46 located on the end of the outer axial sleeve 44. The angle ring 46 serves to guide the male counterpart into the female connector as well as protecting the bent portion of the wires adjacent the ends 42 of the axial sleeves from physically contacting the first contact member 28 of the male counterpart upon insertion of the male counterpart into the female connector. The inner axial sleeve 40 is located axially between the base 45 of the female connector and the angle ring 46. Sufficient space is allowed between the inner axial sleeve 40 and the base 45 of the female connector and the angle ring 46 to allow the resilient conducting wires to be wrapped around the ends 42 of the inner axial sleeve. In the embodiment shown in FIGS. 1–6, the outer axial sleeve 44 is provided with an inner radially projecting notch 47 in order to secure the angle ring 46 to the inside of the outer axial sleeve 44. As previously discussed, the angle ring 46 shown in the illustrated embodiment may not be needed in an alternate embodiment with a single outer axial sleeve.

As an alternative to the contact structure discussed above, the outer tubular assembly of the present invention can include any suitable well-known type of contact system. The outer tubular assembly may include any number of wires, ranging from one wire to several hundred wires, depending on the size and specific application of the connector. The figures show by way of example only, an embodiment having eight wires.

In accordance with the present invention, the female electrical connector includes an inner structure. The inner structure has a longitudinal axis and a second inner surface for receiving a second contact member of the male counterpart.

In the illustrated embodiment, the female electrical connector includes an inner tubular assembly. The inner tubular assembly is substantially similar to the outer tubular assembly previously described. As embodied herein, the inner tubular assembly 26 has a longitudinal axis x, and includes a second inner surface 58 for receiving a second contact member 30 of the male counterpart 22. Second contact member 30 of the male counterpart is a pin in the embodiment shown in FIGS. 1–6.

In accordance with the present invention, the inner structure further includes at least one resilient conducting wire mounted within the inner structure for contacting the second contact member of the male counterpart upon insertion of the second contact member of the male counterpart into the inner structure. The at least one resilient conducting wire has opposite ends and a central portion. The opposite ends are contacting and fixed to the inner structure. The central portion is spaced from the second inner surface prior to insertion of the second contact member of the male counterpart into the inner structure and displaced toward the second inner surface upon insertion of the second contact member of the male counterpart into the inner structure.

In the illustrated embodiment, the inner tubular assembly 26 includes at least one resilient conducting wire 52 mounted within the inner tubular assembly for contacting the second contact member 30 of the male counterpart upon insertion of the second contact member of the male counterpart into the inner tubular assembly. The resilient conducting wire 52 has opposite ends 54 contacting and being fixed to the inner tubular assembly. The resilient conducting wire also includes a central portion 56 spaced from the second inner surface 58 prior to insertion of the second contact member 30 of the male counterpart 22 into the inner tubular assembly and displaced toward the second inner surface 58 of the upon insertion of the second contact member of the male counterpart into the inner tubular assembly.

In accordance with the present invention, the inner structure includes a plurality of the resilient conducting wires. Each resilient conducting wire of the inner structure extends at a non-intersecting angle to the longitudinal axis of the inner structure and is held in position so that the central portion is suspended from the second inner surface. The plurality of resilient conducting wires form a generally hyperboloid shape prior to insertion of the second contact member of the male counterpart into the inner structure.

In the illustrated exemplary embodiment, the inner tubular assembly includes a plurality of the resilient conducting wires 52 as shown in FIGS. 1–6. Each resilient conducting wire 52 extends at a non-intersecting angle θ to the longitudinal axis x of the inner tubular assembly. Each resilient conducting wire 52 is held in position so that the central portion 56 of the wire is suspended from the second inner surface 58 prior to insertion of the second contact member 30 of the male counterpart 22 into the inner tubular assembly. The plurality of resilient conducting wires form a generally hyperboloid shape as shown in FIG. 6 prior to insertion of the second contact member 30 of the male counterpart into the inner tubular assembly. The wires 52 are typically attached in tension so that the wires will extend from one end to the other in a straight line. The structure of the inner tubular assembly is similar to the structure of the outer tubular assembly in the illustrated embodiment.

In accordance with the present invention, the inner structure further includes an inner axial sleeve and an outer axial sleeve. The second inner surface is located on the inner axial sleeve. The outer axial sleeve surrounds the inner axial sleeve. Opposite ends of the plurality of resilient conducting wires of the inner structure wrap around axial ends of the inner axial sleeve and are press-fit between the inner axial sleeve and the outer axial sleeve in order to fix the opposite ends of the inner structure.

In the illustrated embodiment, inner tubular assembly 26 further includes an inner axial sleeve 60 on which the second inner surface 58 is located. The inner tubular assembly further includes an outer axial sleeve 64 which surrounds inner axial sleeve 60. Outer axial sleeve 64 is comprised of two sleeves, and extends from the base 65 of the inner tubular assembly 26. The inner axial sleeve 60 typically has radial projections 61 which abut against the inside surface of the outer axial sleeve 64. In the illustrated embodiment, the opposite ends of the wires 52 wrap around the axial ends 62 of the inner axial sleeve 60 and are press-fit between the inner axial sleeve 60 and the outer axial sleeve 64. As discussed for the outer tubular assembly, the inner tubular assembly may alternately include no or only one radial projection. The opposite ends of the wires can be attached to the inner tubular assembly by a variety of other methods including brazing, soldering, welding, gluing, or press-fitting with a washer.

In the exemplary embodiment, the inner tubular assembly includes a plurality of resilient conducting wires. However, the inner tubular assembly may contain as few as one resilient conducting wire. In the embodiment shown in FIGS. 1–6, the inner tubular assembly contains five wires. The number of wires is only limited by the space constraints of the inner tubular assembly. Additionally, whereas the wires are shown in the illustrated embodiments as being round, they may be a variety of other shapes such as flat.

The size of the electrical coupling may substantially vary depending on the specific application. By way of example only, the dimensions of a female electrical connector with five wires in the inner tubular assembly and eight wires in the outer tubular assembly similar to that shown in FIGS. 1–6 are as follows: inner resilient conducting wire diameter=0.086 mm; inner tubular assembly outer diameter=1.06 mm; outer resilient conducting wire diameter=0.132 mm; and outer tubular assembly outer diameter=4.68 mm. Dimensions of the male electrical connector in order to correspond with the above example female electrical connector are as follows: male outer tubular assembly diameter=3.15 mm; and male inner tubular assembly diameter=0.38 mm. These values may be greatly varied from the above example. The design of the present invention allows the inner tubular assembly to be made very small, with wires as small as approximately 0.07 mm in diameter at the present time, without an appreciable loss in electrical properties. The provision of the hyperbolic wires inside the inner tubular assembly of a coaxial connector was not previously believed to be feasible. It had not been known that a hyperbolic design of such small size would give good high frequency performance.

The design of the exemplary embodiment allows for a coupling having very low mating forces and a high cycle life. Coaxial cable couplings using the hyperboloid design on the outer and inner tubular assemblies as shown in FIGS. 1–6 have a very low insertion force averaging approximately 3 ounces for each coupling. The cycle life of the contacts is also greatly improved due to the design. Electrical contacts using the above design have a cycle life of over 25,000 cycles. This is up to fifty times greater than standard contacts.

The connectors may be made out of a variety of materials including, but not limited to brass, berylium, copper, or any conventional material used for electrical connectors.

Although the illustrated embodiments show the inner and outer tubular assemblies being coaxial, it is also possible for the inner and outer tubular assemblies to be non-coaxial. In a non-coaxial connector, the longitudinal axis of the inner tubular assembly is not identical to the longitudinal axis of the outer tubular assembly. In addition, although the illustrated embodiments show the inner and outer tubular assemblies being cylindrical, the shape of the inner and outer tubular assemblies do not need to be cylindrical. The inner and outer tubular assemblies can be of any variety of polygonal and curved shapes, ie. elliptical, square, hexagonal, etc., although the cylindrical shape is preferred. Lastly, the illustrated embodiments show the first and second inner surfaces being smooth. However, grooves may be included on the first and second inner surfaces for supporting each individual resilient conducting wire. These grooves would serve to prevent the resilient conducting wires from moving circumferentially.

A second embodiment of the invention will now be described where like or similar parts are identified throughout the drawings by the same reference characters. In accordance with the second embodiment of the present invention, the at least one resilient conducting wire of the inner structure extends generally parallel to the longitudinal axis of the inner structure.

Figure 7:
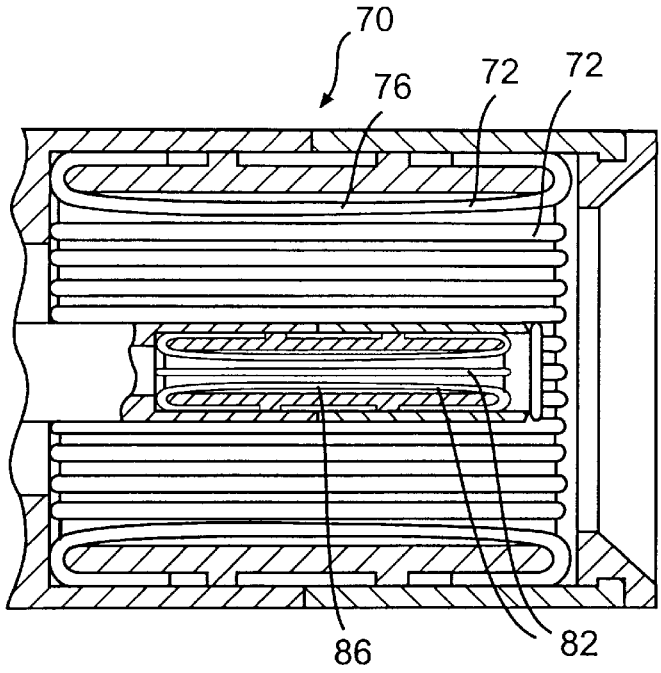
FIG. 7 is a cross-sectional view of a female electrical connector according to a second embodiment.
Figure 8:
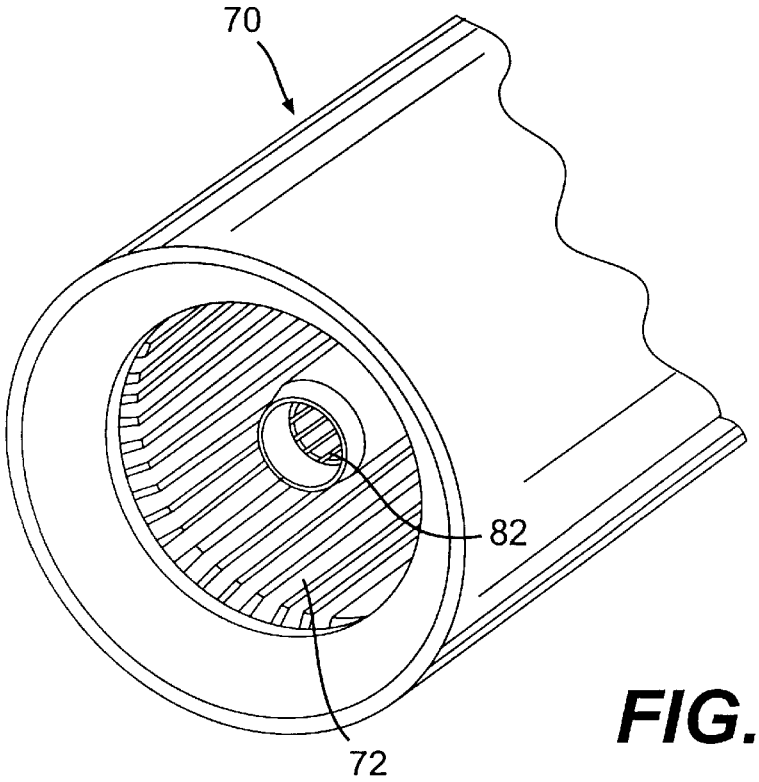
FIG. 8 is a perspective view of the female electrical connector of FIG. 7.
Figure 9:
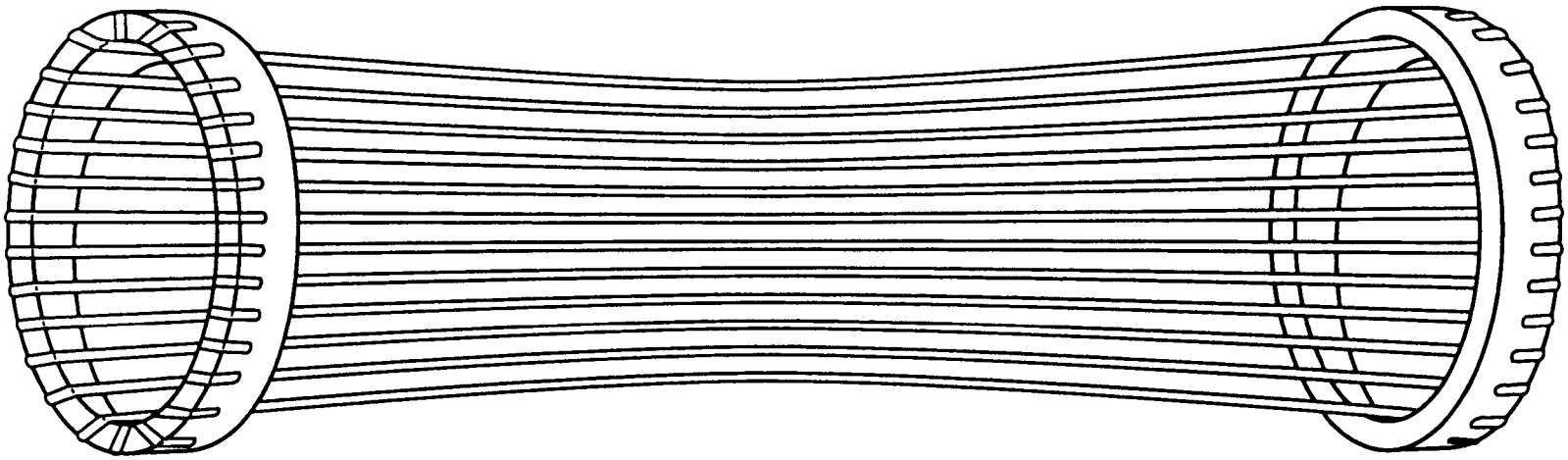
FIG. 9 is a schematic showing the bent design of the wires of the female electrical connector of FIG. 7.

In the illustrated second embodiment shown in FIGS. 7–9, the at least one resilient conducting wire 82 of the inner tubular assembly of the female connector 70 extends generally parallel to the longitudinal axis of the inner tubular assembly. In the second embodiment, the outer tubular assembly also contains at least one resilient conducting wire 72 extending generally parallel to the longitudinal axis of the outer tubular assembly. The design of the outer tubular assembly may be of any conventional design, including the non-intersecting angled conducting wires as shown in the first embodiment.

In the illustrated second embodiment, the female electrical connector 70 includes an outer and inner tubular assembly identical to the first embodiment, except for the configuration and number of resilient conducting wires. In the second embodiment, the resilient wires extend generally parallel to the longitudinal axis. The wires do not extend at a non-intersecting angle as is done in the first embodiment. In addition, it may be desired to provide a greater number of the resilient conducting wires. As shown in FIGS. 7–9, the plurality of resilient conducting wires 82 of the inner tubular assembly are bent so that the central portion 86 of each wire is suspended from its respective inner surface prior to insertion of the male counterpart into the female connector. Therefore, although the wires are not angled relative to the longitudinal axis, they will still radially project into the interior portion of the inner and outer tubular assembly to make contact with the male counterpart upon insertion of the male counterpart into the female connector. The resilient wires will be displaced toward their respective inner surfaces upon insertion of the male counterpart into the female connector. In contrast to the first embodiment, the resilient wires of the second embodiment will be placed in compression by the insertion of the male counterpart into the female connector. The connector of the second embodiment will have different physical attributes than the connector of the exemplary embodiment.

The female connector 70 of the second embodiment will engage a male counterpart identical to the male counterpart 22 described for the first embodiment.

FIG. 9 is a schematic of the second embodiment showing the wires bent so that the total width of the plurality of wires is smaller at the midsection of the connector compared to the end portions. However, each individual wire has a constant cross-sectional wire diameter. Each wire is bent so that it is spaced from its respective inner surface of the tubular assembly.

The second embodiment may be modified by any of the variations discussed for the first embodiment. For example, the outer and inner tubular assembly can include any number of resilient conducting wires from one wire to several hundred wires, depending on the size and specific application of the connector. By way of example only, a typical female connector could have 8 wires on the outer tubular assembly and 5 wires on the inner tubular assembly, similar to the first embodiment. The number of wires can be varied as a function of the amount of mating forces desired, the amount of contact area desired, and the size constraints of the tubular assemblies. Therefore, the number and size of wires will vary with each application. The number and size of the wires will also control the size of the gap between the wires, if a gap is provided. Therefore, the gap is typically in the range from zero to 2.54 mm or more. In addition, the inner and outer tubular assembly may be non-coaxial. The shape of the inner and outer tubular assemblies is not limited to the cylindrical shape shown in the figures. Grooves may be included on the first and second inner surfaces for supporting each individual resilient conducting wire. The wires may be attached by any of the methods described for attaching the wires in the first embodiment. The size, shape, and materials used for the wires may also be varied.

Figure 10:
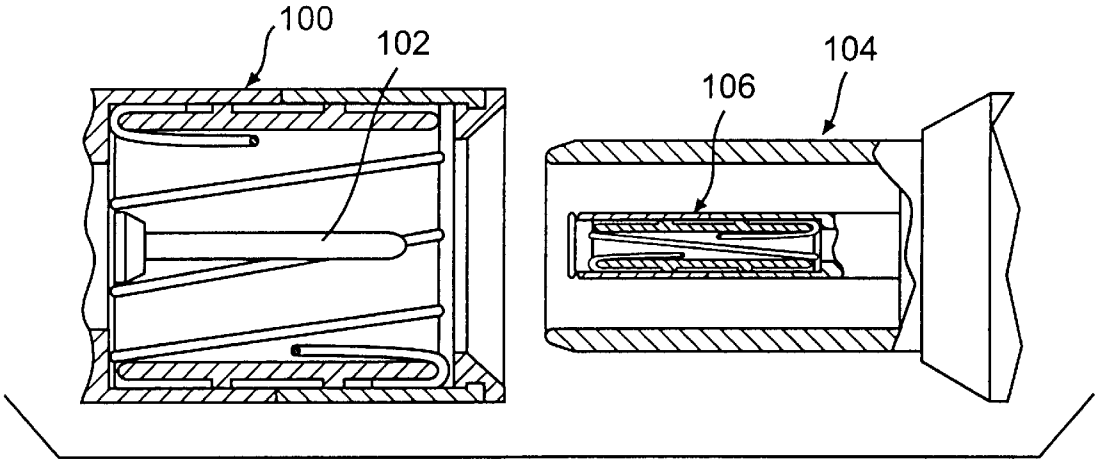
FIG. 10 is a cross-sectional view of an electrical coupling with a female electrical connector and a male counterpart connector according to a third embodiment.

A third embodiment of the invention will now be described with reference to FIG. 10. In this embodiment, the inner structures of the female connector and the male counterpart are reversed compared to the first embodiment. As illustrated in FIG. 10, the female electrical connector 100 is provided with a pin 102, and male counterpart electrical connector 104 is provided with a female member 106 for receiving the pin. Female member 106 is identical to the inner tubular assembly 26 of the first embodiment. Pin 102 is identical to pin 30 of the first embodiment. The FIG. 10 embodiment shows the plurality of resilient conducting wires extending at a non-intersecting angle to the longitudinal axis, similar to the configuration in the first embodiment. The remainder of the structure is subject to all of the variations of the previous embodiments.

Figure 11:
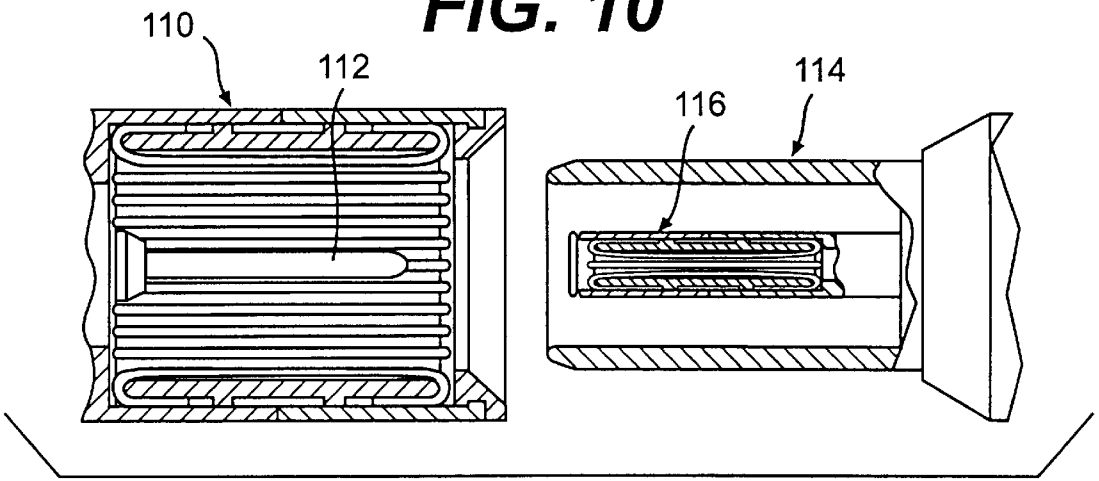
FIG. 11 is a cross-sectional view of an electrical coupling with a female electrical connector and the male counterpart connector according to a fourth embodiment.

A fourth embodiment of the invention will now be described with reference to FIG. 11. In this embodiment, the inner tubular assemblies of the female connector and the male counterpart are reversed compared to the second embodiment. In FIG. 11, the female electrical connector 110 is provided with a pin 112, and male counterpart electrical connector 114 is provided with a female member 116 for receiving the pin. The FIG. 11 embodiment shows the plurality of resilient conducting wires extending generally parallel to the longitudinal axis, similar to the configuration in the second embodiment. The remainder of the structure is subject to all of the variations of the previous embodiments.

For any of the above embodiments, a plurality of the female sockets may be placed on a female coupling body in order to simultaneously couple multiple coaxial cables in parallel. As illustrated by way of example only in FIG. 12, a female coupling body 120 is provided for supporting a plurality of sockets 122. Each socket 122 includes coaxial inner and outer contact assembly tubes identical to those disclosed in the previous embodiments. The coaxial inner and outer contact assembly tubes mate with the inner and outer contact members of male counterpart connectors 124 positioned in a male coupling body 126. The female coupling body 120 supports a plurality of the female sockets 122 each connected to a coaxial cable 128. Each socket 122 is arranged parallel to the other sockets in the female coupling body 120.

Figure 12:
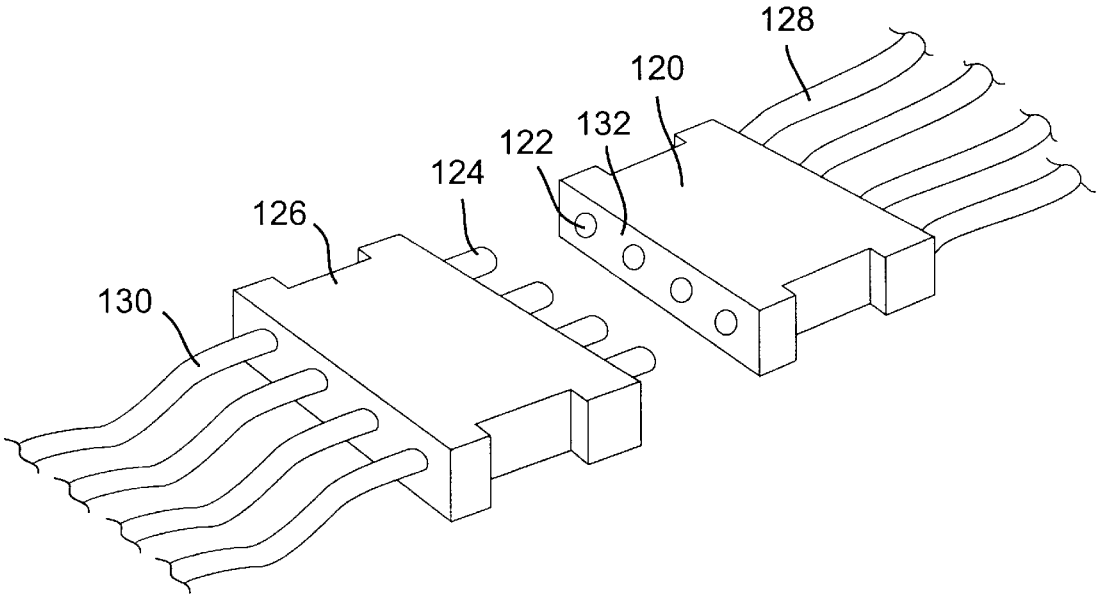
FIG. 12 is a perspective view of a male and female coupling body each having a plurality of connectors.

As illustrated in FIG. 12, male coupling body 126 supports a plurality of male counterpart connectors 124 each connected to a coaxial cable 130. Each male counterpart connector 124 is arranged parallel to the other male counterpart connectors in the male coupling body 126. The male counterpart connectors 124 axially project from the male coupling body and slide into the female sockets 122 located in an end face 132 of the female coupling body 120. Each socket is used to mate with the corresponding contact prongs of a complementary male connector. The sockets and male counterpart connectors can be in the form of any of the sockets and male counterpart connectors discussed in the specification above, including any of the four embodiments illustrated in the four embodiments above.

While FIG. 12 shows the male and female coupling bodies being in the form of a rack and panel arrangement, any other type of coupling arrangement may be utilized. For instance, the connectors of the present invention may be used in printed circuit board connectors, cable-to-chassis connectors, stacking connectors (connector savers) and other types of connectors. In addition, although FIG. 12 shows an embodiment with a female coupling body including only four sockets, any number of sockets may be included on a female coupling body. In some applications, a large number of sockets will be needed on each female coupling body. In applications with a large number of sockets, the lower mating forces of the present invention will be particularly advantageous because the total force needed to disconnect the entire coupling body will be the sum of the extraction forces of each individual socket.

It will be apparent to those skilled in the art that various modifications and variations can be made in the design of the present invention and in construction of this electrical connector without departing from the scope or spirit of the invention. For example, the present invention is not limited to usage in connectors having only two tubular assemblies. The present invention may be used in connectors having more than two tubular assemblies, such as a triaxial connector. In a triaxial connector, the basic structure will be similar to that disclosed in the present invention, with the addition of a third tubular assembly similar to the other two tubular assemblies. The present invention could also be used in connectors having more than three tubular assemblies.

Other embodiments of the invention will be apparent to those skilled in the art from consideration of the specification and practice of the invention disclosed herein. It is intended that the specification and examples be considered as exemplary only, with the true scope and spirit of the invention being indicated by the following claims.

We claim:

1. A female electrical connector for mating with a male counterpart, comprising:

an outer structure having a longitudinal axis and a first inner surface for receiving a first of the male counterpart, the outer structure including a first conductive contact structure mounted within the outer structure for contacting the first contact member of the male counterpart upon insertion of the first contact member of the male counterpart into the outer structure; and an inner structure having a longitudinal axis and a second inner surface for receiving a second contact member of the male counterpart, the inner structure including at least one resilient conducting wire mounted within the inner structure for contacting the second contact member of the male counterpart upon insertion of the second contact member of the male counterpart into the inner structure, the at least one resilient conducting wire having opposite ends and a central portion, said opposite ends contacting and being fixed to the inner structure, said central portion being spaced from the second inner surface prior to insertion of the second contact member of the male counterpart into the inner structure and displaced toward the second inner surface upon insertion of the second contact member of the male counterpart into the inner structure.

2. The female electrical connector of claim 1, wherein the at least one resilient conducting wire of the inner structure extends at a non-intersecting angle to the longitudinal axis of the inner structure, the resilient conducting wire being held in position so that said central portion is suspended from the second inner surface prior to insertion of the second contact member of the male counterpart into the inner structure.

3. The female electrical connector of claim 2, wherein the inner structure and the outer structure are cylindrical.

4. The female electrical connector of claim 3, wherein the inner structure and the outer structure are coaxial.

5. The female electrical connector of claim 2, wherein the first conductive contact structure of the outer structure includes at least one resilient conducting wire having opposite ends contacting and being fixed to the outer structure, and a central portion being spaced from the first inner surface prior to insertion of the first contact member of the male counterpart into the outer structure and displaced toward the first inner surface upon insertion of the first contact member of the male counterpart into the inner structure.

6. The female electrical connector of claim 5, wherein the at least one resilient conducting wire of the outer structure extends at a non-intersecting angle to the longitudinal axis of the outer structure, and is held in position so that the central portion thereof is suspended from the first inner surface prior to insertion of the first contact member of the male counterpart into the outer structure.

7. The female electrical connector of claim 1, wherein the at least one resilient conducting wire of the inner structure extends generally parallel to the longitudinal axis of the inner structure, the resilient conducting wire being bent so that the central portion is suspended from the second inner surface prior to insertion of the second contact member of the male counterpart into the inner structure.

8. The female electrical connector of claim 7, wherein the inner structure and the outer structure are cylindrical.

9. The female electrical connector of claim 8, wherein the inner structure and the outer structure are coaxial.

10. The female electrical connector of claim 7, wherein the first conductive contact structure of the outer structure includes at least one resilient conducting wire, the at least one resilient conducting wire of the outer structure having opposite ends contacting and being fixed to the outer structure, and a central portion being spaced from the first inner surface prior to insertion of the first contact member of the male counterpart into the outer structure and displaced toward the first inner surface upon insertion of the first contact member of the male counterpart into the outer structure.

11. The female electrical connector of claim 10, wherein the at least one resilient conducting wire of the outer structure extends generally parallel to the longitudinal axis of the outer structure, the resilient conducting wire of the outer structure being bent so that the central portion thereof is suspended from the first inner surface prior to insertion of the first contact member of the male counterpart into the outer structure.

12. The female electrical connector of claim 1, wherein the inner structure includes a plurality of said resilient conducting wires.

13. The female electrical connector of claim 12, wherein each said resilient conducting wire of the inner structure extends at a non-intersecting angle to the longitudinal axis of the inner structure and is held in position so that said central portion is suspended from the second inner surface, said plurality of resilient conducting wires forming a generally hyperboloid shape prior to insertion of the second contact member of the male counterpart into the inner structure.

14. The female electrical connector of claim 13, wherein the inner structure and the outer structure are cylindrical.

15. The female electrical connector of claim 14, wherein the inner structure and the outer structure are coaxial.

16. The female electrical connector of claim 15, wherein the first conductive contact structure of the outer structure includes at least one resilient conducting wire, the at least one resilient conducting wire of the outer structure having opposite ends contacting and being fixed to the outer structure, and a central portion spaced from the first inner surface prior to insertion of the first contact member of the male counterpart into the outer structure and displaced toward the first inner surface upon insertion of the first contact member of the male counterpart into the outer structure.

17. The female electrical connector of claim 16, wherein the at least one resilient conducting wire of the outer structure extends generally parallel to the longitudinal axis of the outer structure, the resilient conducting wire of the outer structure bent so that the central portion thereof is suspended from the first inner surface prior to insertion of the first contact member of the male counterpart into the outer structure.

18. The female electrical connector of claim 17, wherein the first conductive contact structure of the outer structure includes a plurality of said resilient conducting wires of the outer structure.

19. The female electrical connector of claim 16, wherein the at least one resilient conducting wire of the outer structure extends at a non-intersecting angle to the longitudinal axis of the outer structure, the at least one resilient conducting wire of the outer structure being held in position so that said central portion thereof is suspended from the first inner surface prior to insertion of the first contact member of the male counterpart into the outer structure.

20. The female electrical connector of claim 19, wherein the first conductive contact structure of the outer structure includes a plurality of said resilient conducting wires of the outer structure forming a generally hyperboloid shape prior to insertion of the first contact member of the male counterpart into the outer structure.

21. The female electrical connector of claim 20, wherein the plurality of resilient conducting wires of the inner structure includes five wires, and the plurality of resilient conducting wires of the outer structure includes eight wires.

22. The female electrical connector of claim 14, wherein the outer diameter of the inner structure is less than 1.2 mm.

23. The female electrical connector of claim 14, wherein the diameter of each of the plurality of resilient coupling wires is less than 0.1 mm.

24. The female electrical connector of claim 14, the inner structure further including an inner axial sleeve on which the second inner surface is located, and an outer axial sleeve which surrounds the inner axial sleeve, wherein said opposite ends of the plurality of resilient conducting wires of the inner structure wrap around axial ends of the inner axial sleeve and are press-fit between the inner axial sleeve and the outer axial sleeve in order to fix the opposite ends to the inner structure.

25. The female electrical connector of claim 14, wherein said opposite ends of the plurality of resilient conducting wires of the inner structure are fixed to the inner structure by brazing, soldering, welding, gluing, or press-fitting with a washer.

26. The female electrical connector of claim 12, wherein each said resilient conducting wire of the inner structure extends generally parallel to the longitudinal axis of the inner structure and is bent so that the central portion is suspended from the second inner surface prior to insertion of the second contact member of the male counterpart into the inner structure.

27. The female electrical connector of claim 26, wherein the inner structure and the outer structure are cylindrical.

28. The female electrical connector of claim 27, wherein the inner structure and the outer structure are coaxial.

29. The female electrical connector of claim 27, wherein the first conductive contact structure of the outer structure includes at least one resilient conducting wire having opposite ends contacting and being fixed to the outer structure, and a central portion being spaced from the first inner surface prior to insertion of the first contact member of the male counterpart into the outer structure and displaced toward the first inner surface upon insertion of the first contact member of the male counterpart into the outer structure.

30. The female electrical connector of claim 29, wherein the at least one resilient conducting wire of the outer structure extends generally parallel to the longitudinal axis of the outer structure, the resilient conducting wire of the outer structure being bent so that the central portion thereof is suspended from the first inner surface prior to insertion of the first contact member of the male counterpart into the outer structure.

31. The female electrical connector of claim 30, wherein the first conductive contact structure of the outer structure includes a plurality of said resilient conducting wires of the outer structure.

32. A coaxial female electrical connector for mating with a male counterpart, comprising:

an outer structure having a longitudinal axis and a first inner surface for receiving a first contact member of the male counterpart, the outer structure including a plurality of first resilient conducting wires mounted within the outer structure for contacting the first contact member of the male counterpart upon insertion of the first contact member of the male counterpart into the outer structure, each of the plurality of first resilient conducting wires having opposite ends and a central portion, said opposite ends contacting and being fixed to the outer structure, said central portion being spaced from the first inner surface prior to insertion of the first contact member of the male counterpart into the inner structure and displaced toward the first inner surface upon insertion of the first contact member of the male counterpart into the outer structure; and an inner structure having a longitudinal axis and a second inner surface for receiving a second contact member of the male counterpart, the inner structure including a plurality of second resilient conducting wires mounted within the inner structure for contacting the second contact member of the male counterpart upon insertion of the second contact member of the male counterpart into the inner structure, each of the plurality of second resilient conducting wires having opposite ends contacting and fixed to the inner structure, and a central portion being spaced from the second inner surface prior to insertion of the second contact member of the male counterpart into the inner structure and displaced toward the second inner surface upon insertion of the second contact member of the male counterpart into the inner structure.

33. The female electrical connector of claim 32, wherein the inner structure and the outer structure are cylindrical.

34. The female electrical connector of claim 33, wherein each said second resilient conducting wire extends at a non-intersecting angle to the longitudinal axis of the inner structure and is held in position so that the central portion thereof is suspended from the second inner surface, said plurality of second resilient conducting wires forming a generally hyperboloid shape prior to insertion of the second contact member of the male counterpart into the inner structure.

35. The female electrical connector of claim 34, wherein each said first resilient conducting wire extends at a non-intersecting angle to the longitudinal axis of the outer structure and is held in position so that the central portion thereof is suspended from the first inner surface, said plurality of first resilient conducting wires forming a generally hyperboloid shape prior to insertion of the first contact member of the male counterpart into the outer structure.

36. The female electrical connector of claim 35, wherein the plurality of second resilient conducting wires includes five wires, and the plurality of first resilient conducting wires includes eight wires.

37. The female electrical connector of claim 33, wherein each said second resilient conducting wire extends generally parallel to the longitudinal axis of the inner structure and is bent so that the central portion thereof is suspended from the second inner surface prior to insertion of the second contact member of the male counterpart into the inner structure.

38. The female electrical connector of claim 37, wherein each said first resilient conducting wire extends generally parallel to the longitudinal axis of the outer structure and is bent so that the central portion thereof is suspended from the first inner surface prior to insertion of the first contact member of the male counterpart into the outer structure.

39. An electrical coupling including a female connector and male connector, comprising:

the female connector having an outer structure and an inner structure, said outer structure of the female connector having a longitudinal axis and a first inner surface for receiving an outer structure of the male connector, said outer structure of the female connector including a first conductive contact structure mounted within the female outer structure for contacting an outer contact member of the male connector upon insertion of the outer contact member of the male connector into the outer structure of the female connector, said inner structure of the female connector having a longitudinal axis and including one of a pin for engaging an inner structure of the male connector and a female member for receiving a pin of the male connector and the male connector having an outer structure and an inner structure, said outer structure of the male connector including said outer contact member for contacting the first conductive contact structure of the female connector upon insertion of the outer contact member of the male connector into the outer structure of the female connector, said inner structure of the male connector including the other of said pin and said female member for receiving the pin, wherein said female member for receiving the pin has a second inner surface for receiving the pin, the female member including at least one resilient conducting wire mounted within the female member for contacting the pin upon insertion of the pin into the female member, the at least one resilient conducting wire having opposite ends and a central portion, said opposite ends contacting and being fixed to the female member, said central portion being spaced from the second inner surface prior to insertion of the pin into the female member and displaced toward the second inner surface upon insertion of the pin into the female member.

40. The electrical coupling of claim 39, wherein said at least one resilient conducting wire of the female member for receiving the pin extends at a non-intersecting angle to the longitudinal axis of the inner structure, the resilient conducting wire being held in position so that the central portion is suspended from the second inner surface prior to insertion of the pin into the female member.

41. The electrical coupling of claim 40, wherein the female member includes a plurality of said resilient conducting wires, said plurality of resilient conducting wires forming a generally hyperboloid shape prior to insertion of the pin into the female member.

42. The electrical coupling of claim 41, wherein the inner structure of the female connector includes the pin.

43. The electrical coupling of claim 41, wherein the inner structure of the female connector includes the female member for receiving the pin.

44. The electrical coupling of claim 39, wherein said at least one resilient conducting wire of the female member for receiving the pin extends generally parallel to the longitudinal axis of the inner structure, the resilient conducting wire being bent so that the central portion is suspended from the second inner surface prior to insertion of the pin into the female member.

45. The electrical coupling of claim 44, wherein the female member includes a plurality of said resilient conducting wires.

46. The electrical coupling of claim 45, wherein the inner structure of the female connector includes the pin.

47. The electrical coupling of claim 45, wherein the inner structure of the female connector includes the female member for receiving the pin.

* * * * *

UNITED STATES PATENT AND TRADEMARK OFFICE

CERTIFICATE OF CORRECTION

PATENT NO. : 6,102,746
APPLICATION NO. : 09/302580
DATED : August 15, 2000
INVENTOR(S) : Frank A. Nania et al.

It is certified that error appears in the above-identified patent and that said Letters Patent is hereby corrected as shown below:

In claim 1, column 11, line 24, "a first of" should read --a first contact member of--.

Signed and Sealed this

Sixteenth Day of March, 2010

David J. Kappos

David J. Kappos
*Director of the United States Patent and Trademark Office*